United States Patent [19]

Narby et al.

[11] Patent Number: 4,990,819

[45] Date of Patent: Feb. 5, 1991

[54] HID LAMP HAVING A CANTED ARC TUBE AND FRAME WITH ROTARY LOCKING JOINTS

[75] Inventors: William R. Narby, Hammondsport, N.Y.; Charles S. Webster, Carlisle, Mass.; Philip H. Wilson, Campbell, Mass.

[73] Assignee: North American Philips Corporation, New York, N.Y.

[21] Appl. No.: 433,064

[22] Filed: Nov. 6, 1989

[51] Int. Cl.[5] ..... H01J 61/34; H01J 9/26

[52] U.S. Cl. ..... 313/25; 445/26

[58] Field of Search ..... 313/25, 634; 445/22, 445/26

[56] References Cited

U.S. PATENT DOCUMENTS

| | | | |
|---|---|---|---|
| 2,901,648 | 8/1959 | Lindsay et al. | 313/25 |
| 2,904,710 | 9/1959 | Beeninga et al. | 313/25 |
| 4,142,122 | 2/1979 | Koza | 313/25 |
| 4,341,975 | 7/1982 | Phillipp et al. | 313/25 |
| 4,410,828 | 10/1983 | Ernest | 313/25 |
| 4,422,004 | 12/1983 | Knecht | 313/25 |
| 4,936,807 | 6/1990 | Kowal | 445/26 X |

FOREIGN PATENT DOCUMENTS

| | | |
|---|---|---|
| 158064 | 7/1984 | Japan . |
| 196555 | 7/1984 | Japan . |

*Primary Examiner*—Sandra L. O'Shea

*Attorney, Agent, or Firm*—Brian J. Wieghaus

[57] ABSTRACT

A high pressure discharge lamp having a partially collapsible frame for holding an arc tube at a predetermined angle to the lamp axis and being insertable through the neck portion of a standard bulged tube outer envelope. The frame has a first frame section welded to a standard stem assembly, a second frame section rotatably joined to the first frame section for holding the arc tube, and a third frame section rotatably joined to the second frame section for engaging the outer envelope opposite the lamp cap. The frame sections are joined by rotary locking joints and are aligned such that they pivot during insertion of the frame sections when the third frame section engages the dome portion of the outer envelope. The rotary locking joints lock with the arc tube at the desired angle.

19 Claims, 3 Drawing Sheets

FIG. 3A
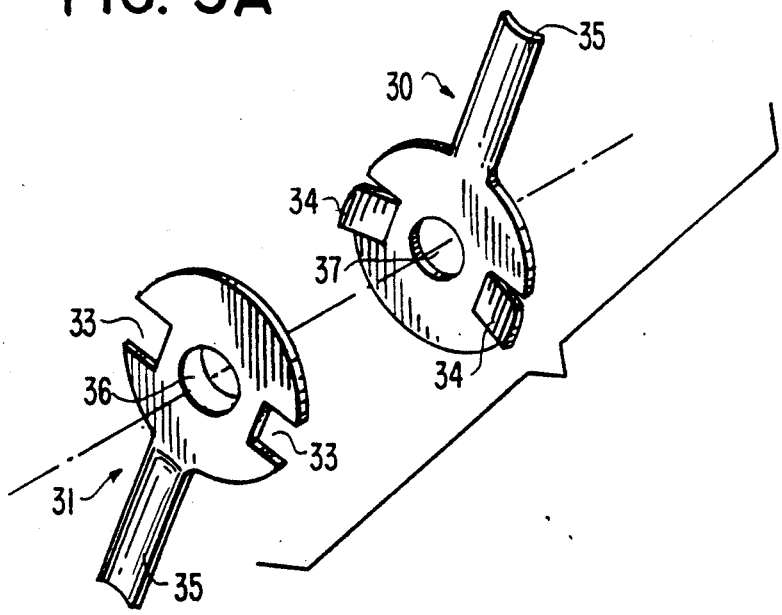
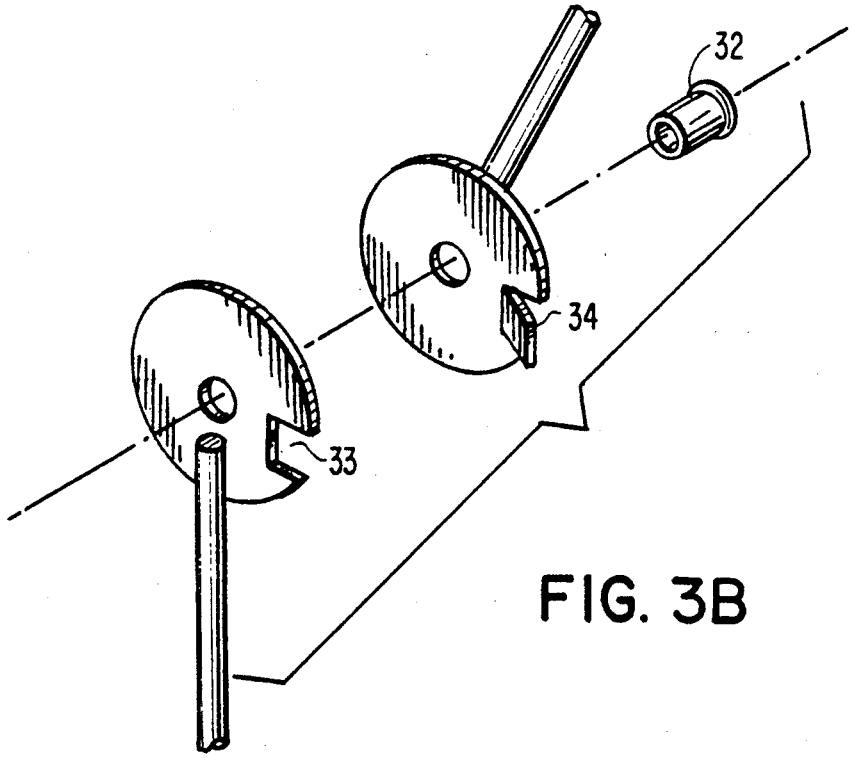
FIG. 3B

HID LAMP HAVING A CANTED ARC TUBE AND FRAME WITH ROTARY LOCKING JOINTS

BACKGROUND OF THE INVENTION

1. Field of the Invention

The invention relates to high intensity discharge (HID) lamps. More specifically, the invention relates to a frame assembly for HID lamps in which a discharge vessel, such as an arc tube, is canted at a predetermined angle with respect to the lamp axis. The invention also relates to a rotary locking joint for connecting sections of the frame.

2. Description of the Prior Art

In the majority of HID lamps, the discharge vessel is arranged in the outer envelope aligned with the lamp axis. The outer envelope has a bulbous portion surrounding the arc tube, and an elongate neck portion extending from the bulbous portion. The arc tube is normally supported in the lamp envelope by a support frame fixed to rigid current-supply conductors extending from the lamp stem through the neck portion of the outer envelope.

The burning orientation of the arc tube in HID lamps affects the efficiency of the lamps. It has been found that a vertical burning position of the arc tube is most efficient, followed by a horizontal burning position. However, in certain lamp applications, it is not practicable to orient the outer bulb in a horizontal or vertical position. For example, in portable light towers for illuminating sports playing fields, the design and position of the reflector for illuminating the playing field limits the orientation of the outer bulb to a base-up orientation with the bulb axis between the vertical and horizontal. Thus, such luminaires would support the arc tube at an angle which is less efficient than the preferred vertical or horizontal burning positions. As a result, prior art lamps having an arc tube aligned with the lamp axis do not provide optimum light distribution or efficiency when operated in such luminaires.

A proposed solution has been to provide a lamp in which the arc tube is supported in the outer envelope at a predetermined angle with respect to the lamp axis. For sports lighting applications, the arc tube is canted such that it would be in a horizontal burning position when secured in a luminaire. However, in lamps having an arc tube canted more than only a few degrees from the lamp axis, the configuration of the frame for supporting the arc tube has prevented the insertion of the frame and arc tube through the elongate neck portion of the standard bulged-tube (BT) outer envelope.

U.S. application Ser. No. 07/312,504, filed Feb. 17, 1989, now U.S. Pat. No. 4,936,807 discloses a solution to the assembly problem which involves severing of the neck portion of the outer envelope from the bulbous portion. A stem assembly having rigid conductors extending from the stem press is first sealed to the neck portion. After severing the neck portion near the bulbous portion, a frame holding the arc tube and having rigid conductors bent for holding the arc tube at the preferred angle is welded to the rigid conductors. The arc tube and frame are then maneuvered through the severed opening and the neck portion is resealed to the bulbous portion. However, this assembly method requires additional equipment for the severing and resealing of the neck portion and is labor intensive, making it comparatively inefficient and expensive compared to the known assembly method for lamps having arc tubes aligned with the lamp axis.

Frame assemblies for canted arc tubes which allow the frame assembly with the arc tube to be inserted through the neck portion of the outer envelope and permit pivoting of the arc tube to the canted position are known in the art. U.S Pat. No. 2,904,710 discloses a frame assembly for securing the arc tube transverse to the lamp axis. The frame assembly has a support aligned with the lamp axis and a cradle for holding the arc tube which is pivotable about the support at the center of the cradle. The cradle is rotated into the transverse position and latched by a latching mechanism prior to sealing of the reentrant stem in the neck portion of the envelope. However, an additional wire separate from the frame and enclosed by an insulator tube is required to energize one of the discharge electrodes.

U.S Pat. No. 4,142,122 discloses a frame with two spaced and curved rods on which the ends of the arc tube slide allowing the arc tube to be pivoted to a transverse position by a coil spring. This frame support has the disadvantage that the arc tube is not locked in the transverse position but is held only by the force of the spring biasing the arc tube ends against pivot stops on the curved rods.

Frame assemblies in which the arc tube is pivotable about one end at a hinge connection with a rigid frame conductor are known from U.S. Pat. No. 4,422,004, U.S. Pat. No. 4,410,828, and JP Kokai No. 59-158064. In U.S Pat. No. 4,410,828, the arc tube is latched in the transverse position by a wire portion secured to the arc tube which cooperates with a notched double-wire clasp spring fixed to the rigid frame conductor. In U.S. Pat. No. 4,422,004, a two-piece connector having a bendable knee joint and extending from one of the conductors in the stem to the lead-in of the arc tube opposite the hinge joint secures the arc tube in the transverse position. These two lamps have the disadvantage that the arc tube must be pivoted by a wand inserted into the envelope during lamp assembly. In JP Kokai No. 158064, a wire of shape memorizing alloy is attached to the end of the support on which the arc tube has a slide connection. During assembly, the wire is relaxed and permits passage of the arc tube through the neck portion. At elevated temperatures, the wire becomes coiled and draws the arc tube into the transverse position. This construction has the disadvantage that the arc tube is secured in position only by the memory alloy wire.

SUMMARY OF THE INVENTION

It is an object of the invention to provide a simplified frame construction for supporting a discharge vessel at an angle with respect to the lamp axis.

It is a further object of the invention to provide a frame assembly which can be welded to a standard stem assembly and can be inserted through the neck portion of a standard bulged tube (BT) outer envelope.

Yet another object of the invention is to provide a frame assembly having a section holding the arc tube which pivots and locks the arc tube in the desired orientation as the arc tube and frame assembly are inserted into the outer envelope through the neck portion.

It is yet another object of the invention to provide a frame joint combining the pivot and locking functions which is compact, comprises only a minimal number of parts, and may be secured to the frame conductors in a simple manner.

It is also an object of the invention to provide a frame construction as above in which the frame joints are conductive such that additional current-supply wires separate from the frame conductors are not necessary.

The objects of the invention are achieved by providing a partially collapsible frame having a first section secured to the lamp stem, a second frame section holding the arc tube which is pivotable with respect to the first section to hold the arc tube in a canted position, and a third section pivotable with respect to the second section which engages the dome portion of the outer envelope opposite the stem. The frame sections, including the second section holding the arc tube, are insertable into the outer envelope through the elongate neck portion with the frame sections substantially aligned. The lengths of the sections are chosen such that, when the frame is inserted, the three frame sections rotate due to the third section engaging the envelope dome portion and through pivoting of the lower frame section during insertion through the neck portion. In the fully inserted position with the lamp stem abutting the neck portion, the second section holding the arc tube is canted at the desired angle. As the second section reaches the desired angle, locks operate automatically to fix the three frame sections. With the three frame sections in the locked position, the lamp stem may then be sealed to the neck portion.

In the preferred embodiment, the second frame section is joined to the other two frame sections by rotary locking joints comprising two rotary members rotatable with respect to each other about a pivot and having locking means for locking the two rotary members to secure the connected frame sections at the desired angle.

A preferred embodiment of the rotary joint has two metallic disks secured to each other to allow relative pivoting. The locking means may comprise a tab on one of the disks bent out of the plane of the disk and a slot in the other of the disks into which the tab is lockingly received When the two disks are in the desired orientation. For more secure locking, the disks may have two slots and two tabs. Both slots may be on one disk and the resilient tabs on the other disk, or each disk may have one slot and one tab. Preferably, the disks and/or tabs are resilient to allow the tab to snap into the slot when the disks are rotated into the locking position.

In an embodiment for the frame, each frame section comprises two parallel rigid conductors connected to a respective rigid conductor of the the adjacent frame section by a rotary locking joint. The rotary locking joints have each rotary member, or disk, welded to a respective conductor of the adjacent frame section. In the first frame section each conductor has one end fixed to the lamp stem, in the second frame section the conductors extend along the arc tube and are secured to the arc tube, and in the third frame section the ends of the conductors from the arc tube are adapted for engaging the dome of the outer envelope.

In the frame according to the preferred embodiment, the third frame section is formed from a single length of wire and is U-shaped, the free ends being welded to the rotary locking joints. The second frame section has only one frame conductor, which extends adjacent one side of the arc tube between the first and third frame sections. On the opposite side of the arc tube, two short members are each secured to a respective pinch seal and to a respective rotary locking joint of the first and third frame sections for further supporting the arc tube.

The rotary locking joints may determine the orientation of the arc tube by locking with the joined conductors extending from the joint at the desired angle. Alternatively, the frame conductors may determine the arc tube orientation by having a bend of the desired angle, for example at the ends of each conductor of the second frame section, and having the rotary joints lock with the joined conductors extending from the joint 180 degrees apart.

It is preferred that the rotary joints are metallic, so that they electrically connect the joined frame conductors which may then energize the arc tube.

BRIEF DESCRIPTION OF THE DRAWINGS

FIGS. 3A and 3B are exploded views of two embodiments of the rotary locking joint. FIG. 3A shows the rotary locking joint according to the preferred embodiment for the lamp of FIG. 1 and FIG. 3B shows another embodiment used in the lamp frame of FIG. 2.

DESCRIPTION OF THE PREFERRED EMBODIMENT

Figure 1:
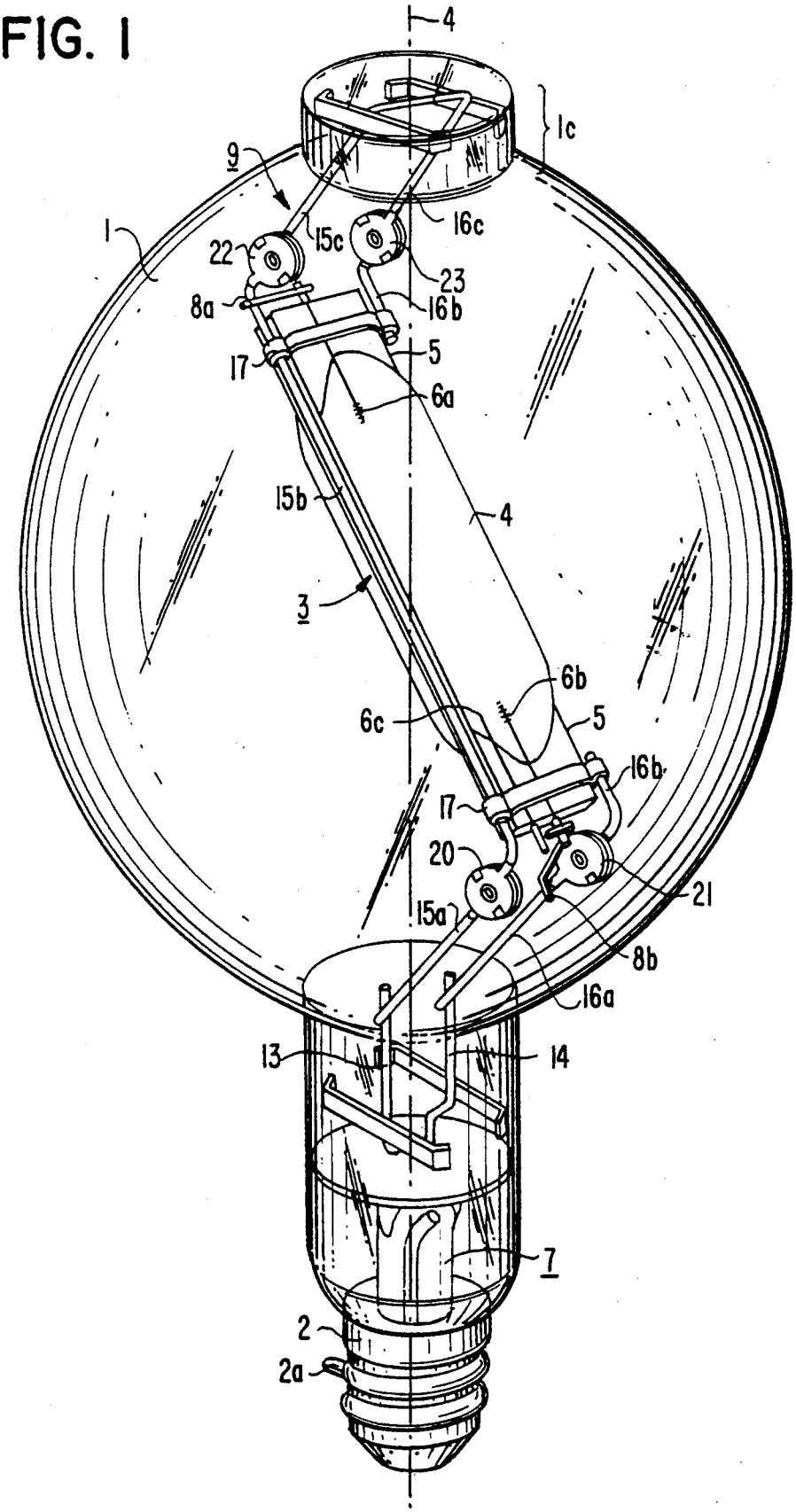
FIG. 1 is a perspective view of a metal halide lamp according to the preferred embodiment of the invention, after installation of the lamp cap.

FIG. 1 shows a metal halide lamp having a standard bulged-tube (BT) glass outer envelope 1 in which a discharge vessel 3, such as a metal halide arc tube, is mounted at a 30 degree angle with respect to the lamp axis 4. The arc tube 3 includes a tubular quartz arc tube 4 having pinch seals 5 at opposite ends which seal the arc tube in a gas-tight manner, discharge electrodes 6*a*, 6*b*, and starting electrode 6*c*. Stem 7 is of a standard type and includes rigid current-supply conductors 13, 14 extending from the stem press which are connected to current-supply wires 13*a*, 14*a*. (FIG. 2) The skirt portion 7*a* of the stem is sealed to the neck portion of the outer envelope in a gas-tight manner. The current supply wires 13*a*, 14*a* are connected to respective contact portions of lamp cap 2. Frame 9 is secured to the stém and holds the discharge device 3 at the preferred angle with respect to the lamp axis 4 and also provides electrical connection to the discharge electrodes 6*a*, 6*b* and starting electrode 6*c*.

Figure 2:
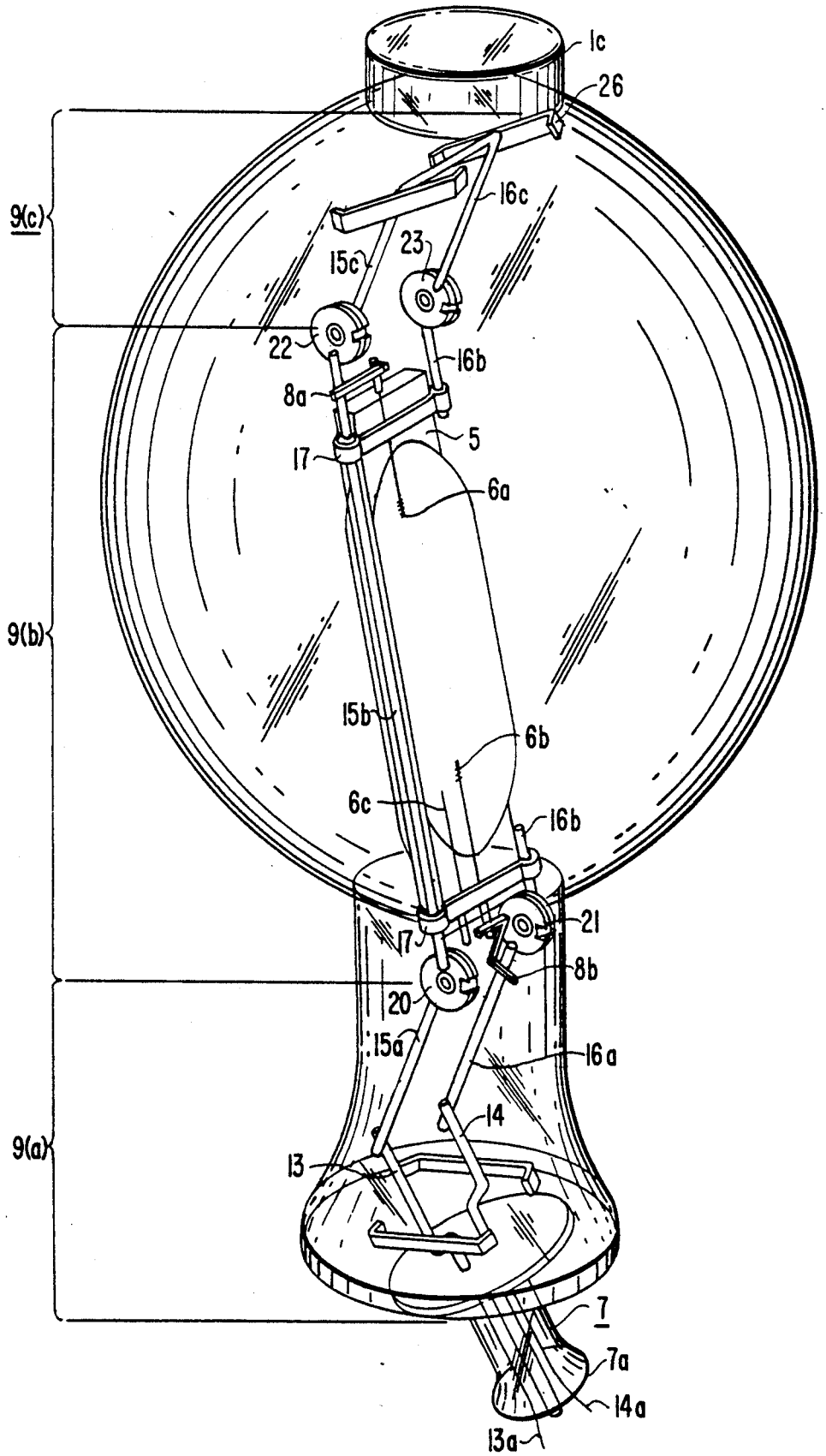
FIG. 2 is a perspective view of a frame assembly according to another embodiment of the invention, partially inserted into the outer envelope.

The frame 9 as shown in FIG. 2 has three frame sections 9(*a*)–(*c*) which are pivotable with respect to each other. The first frame section 9(*a*) has rigid conductors 15*a*, 16*a* welded to the current-supply conductors 13, 14. The second frame section 9(*b*) has one rigid conductor 15*b* which extends along one side of the arc tube 3 and two short members 16*b* adjacent each pinch seal 5 which are secured thereon by metallic bands 17. A quartz glass tube 18 encloses conductor 15*b* and electrically insulates conductor 15*b* from the opposing frame members 16*b*. Frame conductor 15*b* and the lower member 16*b* are connected to frame conductors 15*a*, 16*a* by respective locking rotary joints 20, 21. The third frame section 9(*c*) is a single generally U-shaped rigid wire having legs 15*c*, 16*c* connected to respective conductors of frame section 9(*b*) by rotary locking joints 22, 23. Each leg 15*c*, 16*c* has a resilient band 26 welded thereon which engages the inside surface of the protruding domed portion 1*c* of the outer envelope.

Instead of the frame members 15(*a*), 16(*a*) being welded to the rigid conductors 13, 14 at an angle as shown in FIG. 1, the rigid conductor 13, 14 may be short rods extending from the pinch and the conductors 15*a*, 16*a* may be longer and have a bend at the location of the weld joint of FIG. 1. The longer conductors 15*a*, 16*a* would be welded to the short stem rods adjacent the pinch seal.

Metallic straps 8*a*, 8*b* connect discharge electrodes 6*a*, 6*b* to conductors 15*b* and 16*a*, respectively. Starting electrode 6*c* is connected to conductor 15*a* through a resistor and bimetal switch, not shown.

In the lamp of FIG. 1, the rotary locking joints lock with the joined portions of the conductors extending from the joint at a 180° angle. The angle at which the arc tube is supported is determined by the frame conductors 15*b*, 16*b* which have bent elbow portions at each end. As shown in FIG. 3(*a*), each rotary locking joint comprises two rotary members such as thin metallic disks 30, 31. Disk 31 has a central aperture with a cuff 36 which extends through aperture 37 in disk 30 and is rolled outwards to secure the two disks together and to permit relative rotation of the two disks. The cuff 36 is formed by piercing and extruding the disk 30 to form a flanged hole. Disk 31 has two diametrically opposite slots 33 and disk 30 has two diametrically opposite tabs 34 bent out of the plane of the disk. The disk tabs and slots form a locking means which pivots and lock the two disks during lamp assembly. Each disk also has a straight cupped portion 35 extending therefrom which matches the contour of the joined frame conductors to permit an easier and more secure weld.

Alternatively, the bent elbow portions (FIG. 1) of the frame conductors 15*b*, 16*b* may be substituted by a rotary locking joint which locks with the joined conductors at the preferred angle. A suitable locking joint is shown in FIG. 3(*b*) in which one disk has a slot and the other disk has a bent tab. Instead of having the straight cupped portion, the frame conductors may be directly welded to the disk such that they lock with the frame sections at the desired angle. A rivet 32 may be used to rotatably secure the two disks instead of the tabs 36 of FIG. (3*a*). As shown in FIG. 2, use of the rotary locking joint FIG. 3(*b*) obviates the need for the bent elbow portions of the second frame section as shown in FIG. 1.

Since the rotary locking joints are metallic and are conductive, the discharge electrode 6*b* is electrically connected to the lamp cap by frame members 16*a*, and stem conductors 14, 14*a*. The discharge electrode 6*a* and starting electrode 6*c* are energized through frame parts 15*b*, 20, 15*a* and stem conductors 13, 13*a*. An additional metallic strap, not shown, may be welded to conductors 15(*a*) and 15(*b*) across rotary joint 20 as an electrical shunt to ensure current flow to discharge electrode 6*a*.

As shown in FIG. 2, the arc tube is inserted into the outer envelope by first extending the frame such that all the frame sections, including the second frame section holding the arc tube, may be inserted through the neck portion. The frame sections are inserted into the bulb and the third frame section is guided into the protruding dome portion 1*c*. Before insertion, the frame section 9(*c*) is pivoted a small amount with respect to the second frame section to insure that these two frame sections pivot in the desired direction as the frame is inserted. To insure pivoting in the correct direction, the rotary locking joints must be to the left (in FIG. 2) of a line of action connecting the tip of the bands 26 which first contact the domed portion 1*c* and the rotary locking points 20, 21. As the second and third frame sections begin to pivot, the first frame section 9(*a*) is further inserted through the neck portion. The second and first frame sections rotate in the desired direction due to pivoting of the first frame section through the neck portion, which is necessitated by the angle between, and the length of, the frame conductors 15*a*, 16*a* and stem conductors 13, 14. The stem is inserted into the neck until the frame sections rotate to their full extent and the rotary locking joints lock with the arc tube canted at the desired angle.

The above assembly method is also used for a frame according to FIG. 1 in which the rotary locking joints of FIG. 3(*a*) are used and the bent elbow portions of the second frame section determine the angle of the arc tube. The frame assemblies of FIGS. 1 and 2 are best suited for lamps in which the arc tube is to be supported at an angle of between 20° and 60° with the lamp axis.

After sealing the flared skirt 7*a* of the stem to the neck portion in a known manner, the lamp is completed by providing a lamp cap, such as a Mogul base, connecting each current supply wire 13*a*, 14*a* to a respective contact portion of the base, and cementing the lamp base to the end of the neck portion.

The lamp base has indexing means for insuring that the canted arc tube is correctly positioned in the luminaire and held in the desired burning orientation. For example, an index pin 2*a* may be welded to the crest of a thread of the mogul base at a predetermined location. The socket for receiving the mogul base, not shown, has a stop for the pin which would allow the lamp to be screwed into the socket only a predetermined number of turns so that the arc tube is correctly positioned with respect to the socket. The socket orientation is keyed to the angle of the luminaire to ensure the arc tube is substantially horizontal.

Those of ordinary skill in the art will appreciate that many variations within the scope of the invention are possible. For example, rather than the resilient bands 26 of the frame section 9*c* engaging in an outwardly protruding dome portion of the outer envelope, the outer envelope may have an inwardly protruding dimple engaged by a circumferential clip which is secured to the legs 15*c*, 16*c*. Alternatively, the third frame section may have only one rigid member extending from the second frame section and engaging the dome portion of the envelope. If the only one rigid frame member engages a protruding dimple, there may be enough clearance to insert the frame into the envelope with third frame section rigidly fixed to the second frame section, obviating the need for a rotary joint at that location.

Instead of a rigid frame conductor 15(*b*), a field wire may be used to energize the discharge electrode 6*a*. In the absence of conductor 16(*b*), the arc tube may be fixed to the first and third frame sections simply by straps around the pinch seals. The arc tube would then function structurally as the second frame section. The two frame sections holding each end of the arc tube could be a single rigid member instead of the two parallel members according to FIGS. 1 and 2.

The disks of the rotary locking joints may have shapes other than circular, for example, ovoidal, and the locking tabs and slots may have other configurations. Additionally, one of the disks may have a projection such as a tab which engages the opposite frame wire, or a portion of the other disk, to prevent rotation of the frame sections in the wrong direction during insertion of the frame assembly into the outer envelope.

What is claimed is:

1. A high pressure discharge lamp, said lamp comprising an outer envelope defining a lamp axis and having a bulbous portion and a neck portion extending from the bulbous portion; a stem press sealing said neck portion in a gas tight manner; a discharge vessel disposed within said bulbous portion and energizable for emitting light; and a frame assembly for supporting said discharge vessel at a predetermined angle with respect to said lamp axis comprising a first frame section extending from said press seal through said neck portion and a second frame section canted with respect to the lamp axis for holding said discharge vessel, wherein the improvement comprises:

a rotary locking joint joining said two frame sections, said joint comprising two rotary members each secured to a respective frame section, joining means for rotatably joining said two members for rotation of said frame sections from a first position permitting insertion of said first and second frame sections through said neck portion to a second position for holding said discharge vessel at said predetermined angle, and locking means for locking said rotary members with said discharge device at said predetermined angle.

2. A lamp as claimed in claim 1, wherein each rotary member comprises a thin metallic disk, and said locking means comprises a slot formed in one of said disks and a tab arranged in the other of said disks for engaging in said slot and holding said discharge device at said predetermined angle.

3. A lamp as claimed in claim 2, wherein said joining means comprises a central aperture in one of said disks and a central cuff on the other of said disks extending through said aperture and bent outwardly for rotatably securing said two disks.

4. A lamp as claimed in claim 1, wherein said joining means comprises a central aperture in one of said disks and a central cuff on the other of said disks extending through said aperture and bent outwardly for rotatably securing said two disks.

5. A lamp as claimed in claim 1, wherein said frame assembly further comprises said first frame section having a first pair of rigid conductors extending from said press seal through said neck portion, a pair of rotary locking joints each having a said rotary member secured to a respective conductor of said first pair, and said second frame section having a second pair of rigid conductors secured to said discharge vessel and to the other rotary member of the respective rotary joint.

6. A lamp as claimed in claim 5, wherein each rotary member comprises a thin metallic disk and said locking means comprises a slot formed in one of said disks and a tab arranged in the other of said disks for engaging in said slot and holding said discharge device at said predetermined angle.

7. A lamp as claimed in claim 6, wherein said joining means comprises a central aperture in one of said disks and a central cuff on the other of said disks extending through said aperture and bent outwardly for rotatably securing said two disks.

8. A lamp as claimed in claim 5, wherein said outer envelope has a discontinuity at the end opposite the neck portion; and said frame further comprises a third frame section having a pair of rigid wire legs engaging said discontinuity, and a second pair of rotary locking joints each having a rotary member fixed to a respective rigid leg of the third frame section and the other rotary member fixed to a respective conductor of the second frame section.

9. A lamp as claimed in claim 8, wherein said locking means comprises said rotary members of each locking joint having a pair of slots and a pair of tabs arranged for engaging in a respective slot for holding said discharge device at said predetermined angle.

10. A lamp as claimed in claim 9, wherein each rotary member further comprises a cupped straight portion extending from the disk for conforming to the profile of the joined conductor.

11. A high pressure discharge lamp, comprising:

an outer envelope defining a lamp axis, said envelope having a bulbous portion, a neck portion extending from the bulbous portion, and a dome portion opposite said neck portion;

a stem press having a skirt portion for sealing said neck portion in a gas tight manner;

a discharge vessel energizable for emitting light; and a partially collapsible frame for holding said discharge vessel within said bulbous portion at a predetermined angle to the lamp axis, said frame comprising a first frame section extending from said step press, a second frame section holding said discharge vessel, first rotary joining means for pivotably joining said first frame section to said second frame section, a third frame section for engaging said domed portion of the outer envelope, and second rotary joining means for pivotably joining said third frame section to said second frame section, said frame being insertable during lamp assembly through said neck portion of the outer envelope with said frame sections substantially aligned, said frame sections having a length chosen such that when said frame is inserted into said outer envelope, said third section engages said domed portion and, with said second rotary joining means offset from a line of action between the contact point of said third section with said domed portion and said first rotary joining means, said second section pivots towards said predetermined angle, and upon further insertion of and pivoting of said first frame section and stem assembly into said neck portion, said second frame section and arc tube are disposed at said predetermined angle to said lamp axis; and locking means for locking said first frame section to said second section frame with said second section canted at said predetermined angle.

12. A discharge lamp as claimed in claim 11, wherein said first and second rotary joining means each comprise a rotary joint having first and second rotary members fixed to a respective frame section and joining means for rotatably joining said two members for rotation of said frame sections.

13. A discharge lamp as claimed in claim 12, wherein said rotary members comprise said locking means.

14. A discharge lamp as claimed in claim 13, wherein said rotary members are metallic disks, and said locking means comprises a slot formed in one of said disks and a tab on the other of said disks for engaging in said slot and holding said discharge device at said predetermined angle.

15. A discharge lamp as claimed in claim 14, wherein said discharge device is a quartz arc tube having a pinch seal at each end and said frame further comprises said first frame section having a first pair of rigid frame conductors extending from said press seal through said neck portion, said second frame section having a rigid conductor extending the length of said arc tube, a pair of conductors each extending adjacent a respective pinch seal on the opposing side of said arc tube, and means for connecting said conductors of said second frame section to said arc tube, a first pair of rotary joints each connecting a conductor of said first section with the respective conductor of the second frame section, said third frame section having a pair of rigid wire legs adapted for engaging said dome portion, and a second pair of rotary joints each connecting a wire leg of said third frame section with a respective conductor of said second frame section.

16. A lamp as claimed in claim 15, wherein said second frame section pivots through an angle of between 20 and 60 degrees during insertion of said frame into said lamp envelope.

17. A lamp as claimed in claim 11, wherein said second frame section pivots through an angle of between 20 and 60 degrees during insertion of said frame into said lamp envelope.

18. A method of assembling a high pressure discharge lamp having an discharge vessel canted with respect to the lamp axis, said method comprising the steps of:

(a) providing an outer envelope defining a lamp axis, said envelope having a bulbous portion, a neck portion extending from the bulbous portion, and a dome portion opposite said neck portion;

(b) providing a stem assembly comprising a lamp stem having a pinch seal and a skirt portion for sealing to said neck portion, and a pair of rigid current-supply conductors fixed in said pinch seal;

(c) providing a discharge vessel;

(d) providing a partially collapsible frame for holding said discharge vessel within said bulbous portion at a predetermined angle to the lamp axis, said frame comprising a first frame section extending from said stem press, a second frame section holding said discharge vessel, first rotary joining means for pivotably joining said first frame section to said second frame section, a third frame section for engaging said domed portion of the outer envelope, and second rotary joining means for pivotably joining said third frame section to said second frame section, (e) substantially aligning said three frame sections; and (f) inserting said lamp frame into said outer envelope through said neck portion by, guiding said third frame section into said dome portion with said second rotary joining means offset from a line of action between the point of contact of said third section and said dome portion and said first rotary joining means, further inserting said frame into said envelope to move said second rotary joining means away from said line of action to further pivot said third and second frame sections, and inserting said first frame section through said neck portion with a pivoting motion to rotate said second frame to said predetermined angle; and (g) sealing said stem skirt portion to said neck portion in a gas-tight manner.

19. A method as claimed in claim 18, wherein said second frame section pivots through an angle of between 20 and 60 degrees during insertion of said frame into said lamp envelope.

* * * * *